United States Patent [19]

Makino et al.

[11] Patent Number: 4,784,420

[45] Date of Patent: Nov. 15, 1988

[54] ORIENTATION CONTROL APPARATUS FOR SUSPENDER

[75] Inventors: Kazuhiro Makino, Kudamatsu; Yasuhisa Ishii, Hikari, both of Japan

[73] Assignee: Hitachi, Ltd., Tokyo, Japan

[21] Appl. No.: 21,641

[22] Filed: Mar. 4, 1987

[30] Foreign Application Priority Data

Mar. 12, 1986 [JP] Japan ..... 52446/86

[51] Int. Cl.[4] ..... B66C 13/06

[52] U.S. Cl. ..... 294/81.4; 212/147

[58] Field of Search ..... 294/67.5, 81.3, 81.4, 294/86.41; 212/77, 78, 83, 146–148, 195

[56] References Cited

U.S. PATENT DOCUMENTS

| | | | |
|---|---|---|---|
| 3,828,940 | 8/1974 | Cooper | 294/81.4 X |
| 3,900,114 | 8/1975 | Inoue et al. | 294/81.4 X |
| 4,531,647 | 7/1985 | Higuchi et al. | 212/147 |
| 4,563,030 | 1/1986 | Makino | 294/81.4 |

FOREIGN PATENT DOCUMENTS

| | | |
|---|---|---|
| 2713 | 1/1981 | Japan . |
| 6959 | 2/1981 | Japan . |
| 24786 | 5/1982 | Japan . |
| 82986 | 5/1983 | Japan . |

*Primary Examiner*—Johnny D. Cherry

*Attorney, Agent, or Firm*—Antonelli, Terry & Wands

[57] ABSTRACT

An orientation control apparatus for a suspender, comprising a first lever which has two ropes fixed to each of both its ends, a second lever which is disposed so as to be rotatable in a rotating direction of the first lever, a driver which rotates the second lever, and a damping device which connects an end part of the first lever and an end part of the second lever and which operates in case of preventing a deviational motion of the suspender, to allow the rotation of the first lever relative to the second lever and to damp a force for rotating the first lever, and in the other case, to inhibit the first lever from rotating relative to the second lever.

12 Claims, 4 Drawing Sheets

ORIENTATION CONTROL APPARATUS FOR SUSPENDER

FIELD OF THE INVENTION

The present invention relates to an apparatus intended for the control of the orientation of a suspender hung by four ropes in a crane, and for the prevention of the deviational motion of the suspender.

DESCRIPTION OF THE PRIOR ART

The orientation control of a suspender includes three orientation controls for the inclination of the suspender in the transverse direction thereof (namely, the running direction of a trolley hanging down the suspender), hereinbelow termed the "list," the inclination of the suspender in the longitudinal direction thereof, hereinbelow termed the "trim," and the skewing motion of the suspender, hereinbelow termed the "skew." In general, two of the above orientation controls, for example, for the trim and the list are required.

Also the deviational motion of the suspender occurs in the three directions referred to above. Since the deviational motion of the suspender is caused by the running of the trolley, it is the most necessary to prevent the deviational motion of the suspender in the transverse direction thereof.

An orientation control apparatus is disclosed in the official gazette of Japanese Utility Model Registration Application Publication No. 57-24786 (illustrated in FIG. 2 of the drawings of U.S. Pat. No. 4,563,030). This apparatus is adapted to perform the trim and skew of a suspender. It is mounted at an end in the running direction of a trolley. It is so constructed that the truck of an orientation control system is rectilinearly moved by a first cylinder, that two levers are rotatably attached to the truck and are connected by a link, that a second cylinder for turning the levers is interposed between one of the levers and the truck, and that two hoisting ropes for hanging down one longitudinal end of the suspender are coupled to both the ends of one lever, while two hoisting ropes for hanging down the other end of the suspender are coupled to both the ends of the other lever.

When the first cylinder is actuated, the trim is induced, and when the second cylinder is actuated, the skew is induced.

U.S. Pat. No. 4,563,030 mentioned above discloses an orientation control apparatus which gives rise to inclinations by means of a screw feed mechanism constructed of a motor, nuts, and threaded shafts.

On the other hand, apparatuses for preventing the deviational motion of a suspender have been as follows:

The apparatus disclosed in the official gazette of Japanese Utility Model Registration Application Publication No. 56-2713 is such that a deviation preventive device is disposed at each end in the running direction of a trolley. In this apparatus, a lever is rotatably mounted at the end of a running path, two hoisting ropes for hanging down one end of the suspender in the longitudinal direction thereof are coupled to both the ends of the lever, and an attenuator is interposed between the running path and the lever. The same constituents are disposed for hoisting ropes on the other end side. According to this apparatus, the deviational motion of the suspender in the transverse direction thereof can be prevented.

The apparatus disclosed in the official gazette of Japanese Patent Application Publication No. 56-6959 is disposed on a trolley. In this apparatus, a beam which has a sheave for supporting a hoisting rope is mounted on the trolley in a manner to be vertically turnable about a center in the running direction of the trolley, cylinders are respectively interposed between both the ends of the beam and the trolley, and the medium passages of the two cylinders are connected through a throttle as well as a magnet valve.

The magnet valve sets the timing of the operation of a damping device which is composed of the two cylinders and the throttle. More specifically, in case of starting the running of the trolley, the passage of the magnet valve is opened, and the beam, accordingly the suspender, is inclined, whereupon the passage is closed in that state, and in case of stopping the trolley, the passage of the magnet valve is opened again, and a damping action is effected. Thus, the period of time required for preventing the deviational motion is shortened, and the amplitude of the deviation motion is reduced.

An apparatus disclosed in the official gazette of Japanese Patent Application Laid-open No. 58-82986 is intended to perform both an orientation control and a deviational motion-preventing operation. The expedient therefor is that cylinders for the orientation control are used as those of a damping device so as to prevent a deviational motion. The apparatus can control the three orientations of the trim, list and skew and can similarly prevent deviations in three directions. It is installed on the upper surface of a suspender. The first frame is mounted on the upper surface of the suspender so as to be movable transversely of the suspender by means of the first cylinder, the second frame is mounted on the upper surface of the first frame so as to be movable longitudinally of the suspender by means of the second cylinder, the third frame is mounted on the upper surface of the second frame so as to be horizontally skewable by means of the third cylinder, and ropes are connected to both the ends of the third frame. When the respective cylinders are used for drive, the orientation control of the suspender can be conducted, and when they are used for damping, the prevention of the deviational motion of the suspender can be conducted.

As stated above, it has been known that both the orientation control and the prevention of the deviational motion are effected with the single apparatus.

Since, however, each of the cylinders is switchedly used for the drive and for the damping, piping and arrangement for the switching are complicated.

Another drawback concerns the magnitude of stretch or contraction of the piston rod of each cylinder. Under the state under which the piston rod is protruded in order to incline the suspender toward one side, the piston rod needs to be further stretched or contracted in order to prevent the deviational motion. Meanwhile, under the state under which the piston rod is retracted in order to incline the suspender toward the other side, the piston rod needs to be further stretched or contracted in order to prevent the deviational motion. Therefore, a cylinder whose piston rod has large magnitudes of stretch and contraction is required for achieving both the inclination of the suspender and the prevention of the deviational motion of the suspender with each single cylinder.

SUMMARY OF THE INVENTION

An object of the present invention is to provide an apparatus capable of performing both the orientation control of a suspender and the prevention of the deviational motion of the suspender, in which the orientation control and the prevention of the deviational motion can be respectively effected by individual devices.

The present invention is characterized by comprising a first lever which is mounted so as to rotate about its center between both its ends, and which has one end thereof connected to two ropes for hanging one end of the suspender, in a manner to substantially oppose to each other, and the other end thereof connected to two ropes for hanging the other end of the suspender, in a manner to substantially oppose to each other; a second lever which is mounted so as to be rotatable in a rotating direction of said first lever; a driver which rotates said second lever; and a damping device which connects at least one end of said first lever with at least one end of said second lever, and which operates in case of allowing said first lever to rotate relative to said second lever, to damp a force for rotating said first lever, and in the other case, to inhibit said first lever from rotating relative to said second lever.

Other objects and features of the present invention will become apparent from the following description taken with reference to the drawings.

PREFERRED EMBODIMENT OF THE INVENTION

The present invention will be described in conjunction with one embodiment illustrated in FIGS. 1–6. This embodiment consists in an apparatus which performs the trim and the list of a suspender as an orientation control and the prevention of the deviation of the suspender in the transverse direction thereof as a deviational motion-preventing operation.

Figure 6:
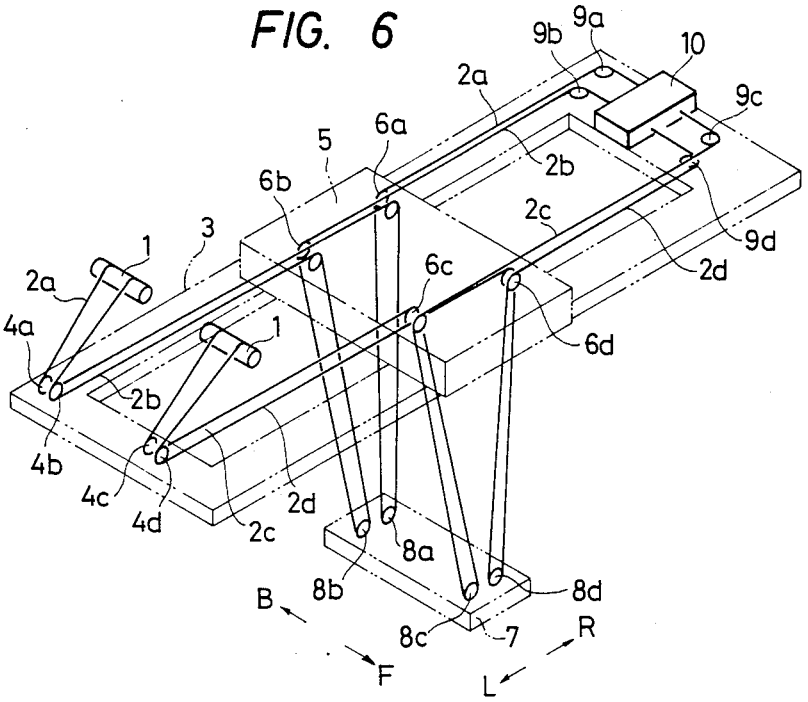
FIG. 6 is an arrangement diagram of ropes in a crane.

The overall system construction will be described with reference to FIG. 6. Ropes 2*a*, 2*b*, 2*c* and 2*d* from a winch 1 are successively extended around sheaves 4*a*, 4*b*, 4*c* and 4*d* located at one end of a girder 3, around one side of sheaves 6*a*, 6*b*, 6*c* and 6*d* mounted on a trolley 5 adapted to run along the girder 3, around sheaves 8*a*, 8*b*, 8*c* and 8*d* on a suspender 7, around the other side of the sheaves 6*a*, 6*b*, 6*c* and 6*d* of the trolley 5, and around sheaves 9*a*, 9*b*, 9*c* and 9*d* located at the other end of the girder 3, whereupon the ropes are connected to an orientation control apparatus 10 installed at the other end of the girder 3.

This orientation control apparatus 10 will be described in detail with reference to FIGS. 1–5.

Figure 1:
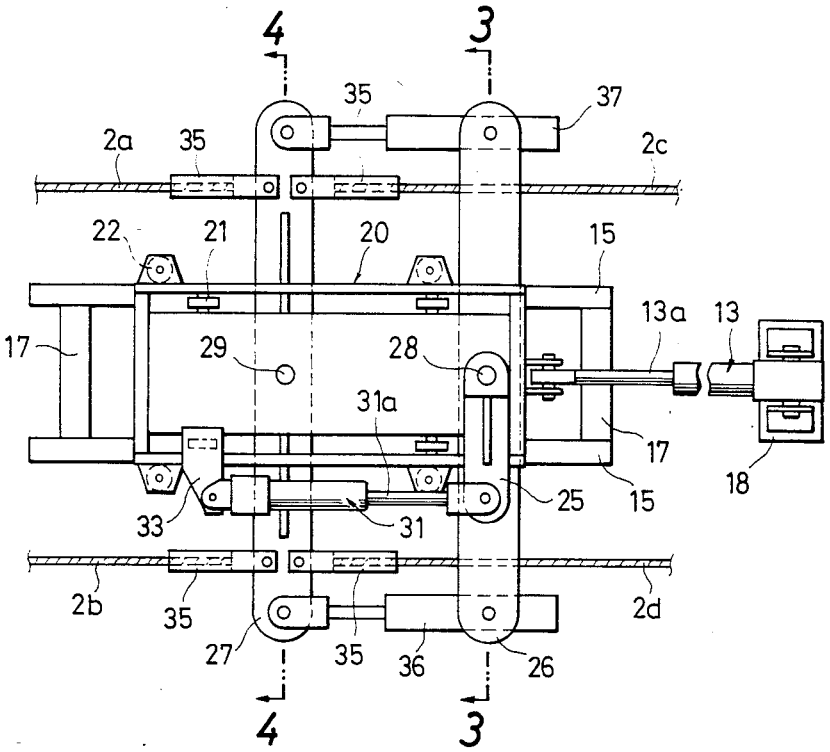
FIG. 1 is a plan view of an embodiment of an orientation control apparatus for a suspender according to the present invention.
Figure 2:
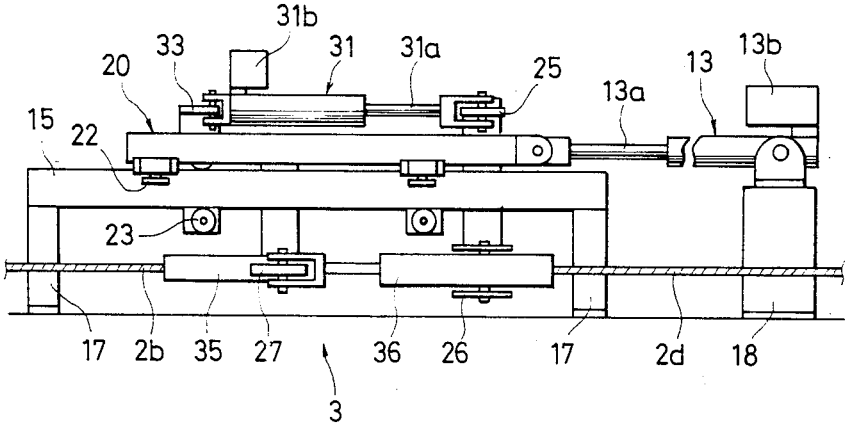
FIG. 2 is a front view of the embodiment in FIG. 1.

Referring to FIG. 1, a truck 20 is rectilinearly moved between the sheaves 9*a*, 9*b* on one side and the sheaves 9*c*, 9*d* on the other side by a first driver 13. The truck 20 runs on two rails 15 which are horizontally arranged on the girder 3. This truck 20 is furnished with four rollers 21 lying in contact with the upper surfaces of the rails 15, four rollers 22 lying in contact with the side surfaces of the rails 15, and four rollers 23 lying in contact with the lower surfaces of the rails 15. Thus, it becomes capable of only the rectilinear movement. The first driver 13 is a cylinder device (of, for example, the ball-and-gear type) employing a screw feed mechanism. Alternatively, it may be a piston-cylinder assembly of the hydraulic type. The fore end of the rod of the first driver, the rod being free to protrude and retreat, is connected to an end part of the truck 20. As illustrated in FIG. 2, the rails 15 and the cylinder of the cylinder device 13 are mounted on the upper surface of the girder 3 through stands of predetermined heights, respectively. The interspace between the two rails 15 and 15 is vacant.

The truck 20 is furnished with three levers 25, 26 and 27 so as to be horizontally rotatable about pivots 28 and 29. The levers 25 and 26 are fixed to the single rotatable pivot 28.

A second driver 31 for rotating the lever 25 is interposed between this lever 25 and the truck 20. The connection point of the lever and the truck is rotatable. The second driver 31 is, for example, a cylinder device of the ball-and-gear type and is installed in the horizontal direction. This second driver may well be a piston-cylinder assembly of the hydraulic type. The fore end of the rod of the cylinder device 31, the rod being free to protrude and retreat, is connected to the fore end of the lever 25. An end part of the cylinder of the cylinder device 31 is connected to a bracket 33 erected on the upper surface of the truck 20, and the connection point of them is rotatable.

In the present embodiment, the first driver 13 and the second driver 31 are the cylinder devices employing screw feed mechanisms. As is well known, the cylinder devices 13, 31 of the screw feed mechanism type are constructed of motors 13*b*, 31*b*, nuts (not shown) which are rotated by the motors 13*b*, 31*b*, and threaded rods 13*a*, 31*a* which are rectilinearly moved by the rotations of the nuts.

As shown in FIG. 2, the bracket 33 and the lever 25 are mounted above the upper surfaces of the rails 15 and the truck 20. The levers 26 and 27 are mounted below the lower surfaces of the rails 15 and the truck 20.

The ropes 2*a* and 2*c* are connected to one end of the lever 27, while the ropes 2*b* and 2*d* are connected to the other end of the same. The ropes are rotatably connected to the lever 27 by respective rope grips 35. The ropes 2*a* and 2*c*, or the ropes 2*b* and 2*d* oppose to each other. Although no illustration is made, the ropes 2*a* and 2*c* are formed of a single rope, which is slackened between the two grips. Also, the ropes 2*b* and 2*d* are formed of a single rope, which is slackened between the two grips.

One end of the lever 26 and that of the lever 27 are connected by a piston-cylinder assembly 36 of the hydraulic type. In addition, the other end of the lever 26 and that of the lever 27 are connected by a piston-cylinder assembly 37 of the hydraulic type. More specifically, the outer peripheral surfaces of the cylinders of the piston-cylinder assemblies 36 and 37 are rotatably mounted on the lever 26. The fore ends of the rods of the piston-cylinder assemblies 36 and 37 are rotatably mounted on the lever 27. The connection points of the levers 26, 27 and the piston-cylinder assemblies 36, 37 define a parallelogram.

The connection points between the rope grips 35 and the lever 27 lie on the inner sides (namely, nearer to the pin 29) with respect to the connection points between the rods of the piston-cylinder assemblies 36, 37 and the lever 27. This is intended to lessen the eccentricity of the truck 20 which is caused by forces acting on the ropes 2a–2d.

Figure 3:
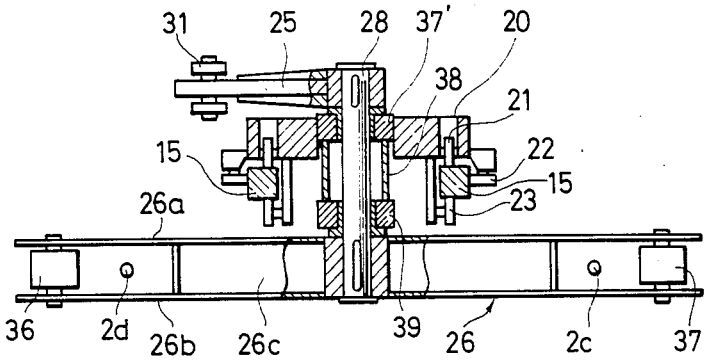
FIG. 3 is a sectional view taken along line 3—3 in FIG. 1.
Figure 4:
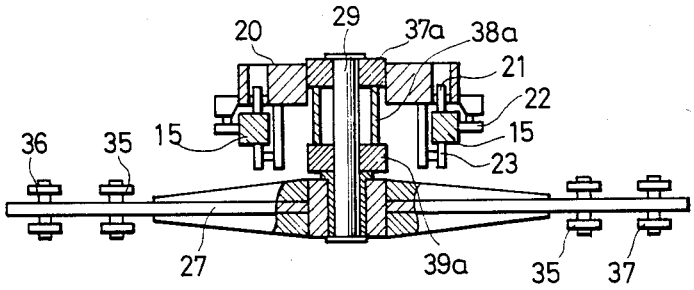
FIG. 4 is a sectional view taken along line 4—4 in FIG. 1.

Referring to FIGS. 3 and 4, the ends of each of the pivots 28 and 29 project upwards and downwards from the truck 20. The pivots 28, 29 are supported on the truck 20 by means of upper sockets 37', 37a, and sockets 39, 39a hung down by sleeves 38, 38a. The pivot 28 is rotatable, and has the levers 25 and 26 fixed thereto. The pivot 29 is not rotatable.

The lever 26 is so configured that upper and lower plates 26a and 26b are connected by a plate 26c. The piston-cylinder assemblies 36 and 37 are interposed between the plates 26a and 26b. The ropes 2c and 2d penetrate a space defined among the plates 26a, 26b and 26c.

Figure 5:
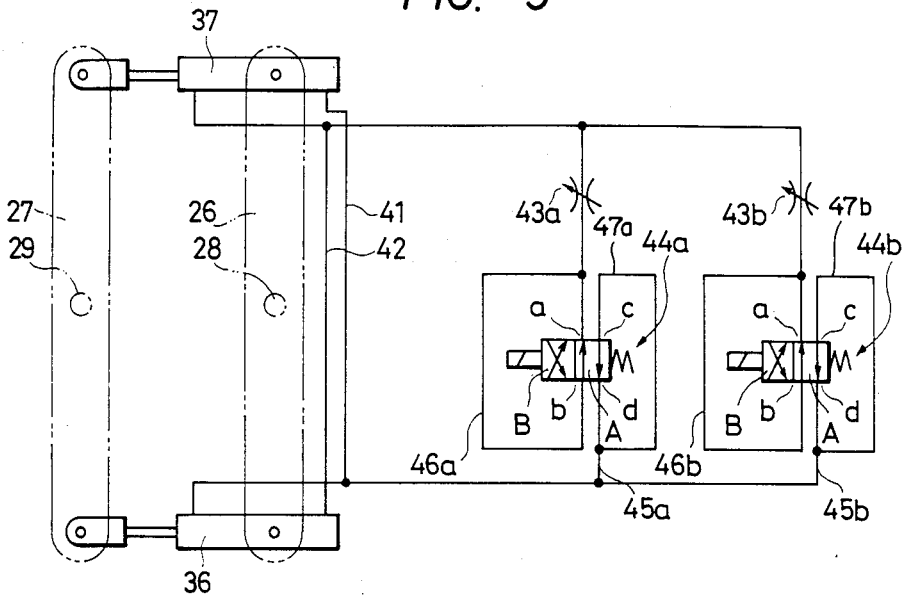
FIG. 5 is a circuit diagram of a damping device.

Referring to FIG. 5, the chamber of the piston-cylinder assembly 36 near the rod thereof and that of the piston-cylinder assembly 37 opposite the rod thereof are connected by a first passage 41. The chamber of the piston-cylinder assembly 36 opposite the rod thereof and that of the piston-cylinder assembly 37 near the rod thereof are connected by a second passage 42. The first passage 41 and the second passage 42 are connected by a third passage 45a as well as a fourth passage 45b. A throttle valve 43a and a magnet valve 44a are arranged in the third passage 45a, while a throttle valve 43b and a magnet valve 44b are arranged in the fourth passage 45b. Each of the magnet valves 44a and 44b has four ports a, b, c and d. The magnet valves 44a and 44b have two operating positions; a position A where the ports a and b and those c and d are connected, and a position B where the ports c and d and those b and c are connected. Fifth passages 46a and 46b for connecting the ports a and the ports b are respectively connected in parallel with the magnet valves 44a and 44b. Likewise, sixth passages 47a and 47b for connecting the ports c and the ports d are respectively provided in parallel with the magnet valves 44a and 44b. Owing to the above arrangement, a damping device is constructed.

The operation of the embodiment constructed as thus far described will be explained.

In case of performing the trim, the first driver 13 is actuated to move the truck 20. Now, when the rod of the first driver (cylinder device) 13 is contracted, the front side F of the suspender 7 lowers and the back side B thereof rises as viewed in FIG. 6.

In case of performing the list, the second driver 31 is actuated to rotate the lever 25. Upon the rotation of the lever 25, the lever 26 rotates through the pivot 28, and the lever 27 rotates through the piston-cylinder assemblies 36, 37. Now, when the rod of the second driver (cylinder device) 31 is contracted, the left side L of the suspender 7 lowers and the right side R thereof rises as viewed in FIG. 6.

In the case of performing the trim or the list, the magnet valves 44a and 44b are kept deenergized and and are thus held at the position A so as to prevent the protrusive lengths of the rods of the piston-cylinder assemblies 36 and 37 from changing. With the magnet valves 44a and 44b held at the position A, the state of FIG. 5 is established under which the third passage 45a and the fourth passage 45b are cut off, so that the rods of the cylinder devices 36 and 37 cannot move.

In case of performing the prevention of the deviation in the transverse direction (horizontal direction), the first driver 13 and the second driver 31 are fixed so as not to operate. Basically, when the solenoid valves 44a and 44b are energized, the damping device is permitted to operate, and the deviation-preventing operation is effected. When energized, the magnet valves 44a and 44b are brought to the position B, so that the third passage 45a and the fourth passage 45b are opened. In consequence, a liquid is permitted to flow through the throttle valves 43a and 43b, the rods of the piston-cylinder assemblies 36 and 37 become free to protrude and retreat, and the lever 27 becomes rotatable, whereby the prevention of the deviation in the transverse direction is effected.

When the magnet valves 44a and 44b are controlled as stated below, it will be possible to shorten the period of time necessary for the prevention of the deviation and to reduce the amplitude of the deviation. In starting the running of the trolley 5, the magnet valves 44a and 44b are energized beforehand. On this occasion, the running of the trolley 5 causes the suspender 7 to deviate rearwards in the running direction of the trolley 5. Since the third passage 45a and the fourth passage 45b are open, the lever 27 rotates due to the deviation. Under the state under which the suspender 7 has deviated rearwards, the energization of the magnet valves 44a and 44b are stopped. Desirably, the magnet valves 44a and 44b are deenergized when the suspender 7 has deviated to the rearmost point. Subsequently, in order to stop the trolley 5 at a halting point, deceleration is started, and at a predetermined time (a predetermined distance) before the halting point, the magnet valves 44a and 44b are energized again for starting a damping action. When the deviation has stopped, the magnet valves 44a and 44b are deenergized.

Besides, in a case where the suspender 7 is hanging down a burden, that is, where a heavy load is borne, only one of the magnet valves 44a and 44b is energized for the prevention of the deviation. In a case where the suspender 7 is not hanging down a burden, that is, where a light load is borne, both the magnet valves 44a and 44b are energized as stated above.

Since, as thus far described, the driving device (31) for the orientation control and the damping device (36, 37, etc.) for the prevention of the deviational motion are different, the switching operation is dispensed with, and the overall construction can be simplified. Moreover, the magnitude of stretch or contraction of the rod of each device can be rendered smaller.

The driving device for the orientation control is constructed of the screw feed mechanisms 13 and 31. As is well known, therefore, the threaded rods 13a and 31a are not protruded or retracted by external forces (forces exerted from the sides of the ropes 2a, 2b, 2c and 2d), and safety is ensured. The brakes of the motors 13b and 31b of the respective screw feed mechanisms 13 and 31 can be reduced in size.

Since the cylinder device 31 of the screw feed mechanism is disposed above the truck 20, the maintenance and inspection thereof is facilitated. In addition, since the piston-cylinder assemblies 36, 37 and the rope grips 35 are located on the outer sides with respect to the rails 15, the maintenance and inspection operations thereof can be facilitated.

Since the side surfaces of the cylinders of the piston-cylinder assemblies 36, 37 are mounted on the lever 26, the overall size of the orientation control apparatus can be rendered smaller.

Although the two piston-cylinder assemblies 36 and 37 are employed for the damping device, only one may well be used.

The second driver 31 may well be one in which the pivot 28 is rotated by gears etc.

Such an orientation control apparatus can be installed on the trolley in a known manner.

Figure 7:
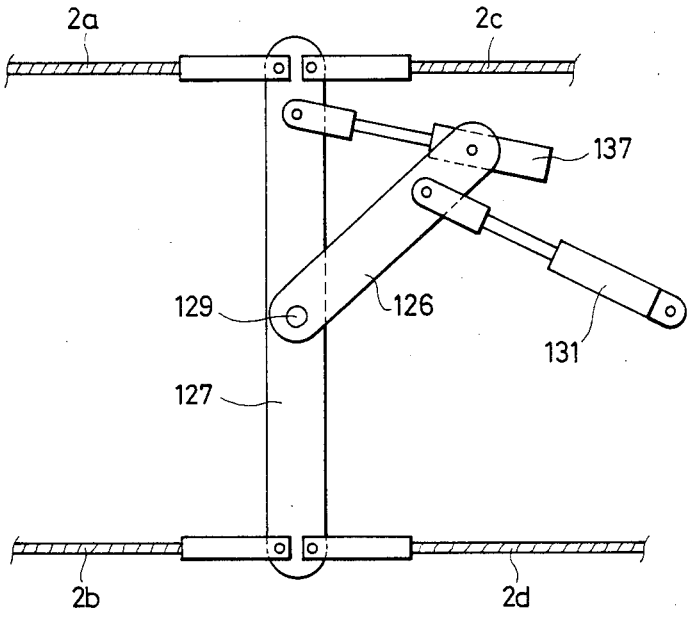
FIG. 7 is a plan view of another embodiment of the orientation control apparatus for a suspender according to the present invention.

Another embodiment shown in FIG. 7 will be described. In this embodiment, a lever 127 for fixing ropes *2a, 2b, 2c* and *2d* and a lever 126 for mounting the piston-cylinder device 137 of a damping device are disposed on an identical pivot 129. The lever 126 is slanted to the lever 127. Shown at numeral 131 is a driver for rotating the lever 126. In the illustration of the embodiment, a truck is omitted.

What is claimed is:

1. An orientation control apparatus for a suspender, comprising:

a first lever which is mounted so as to rotate about its center between both its ends, and which has one end thereof connected to two ropes for hanging one end of the suspender, in a manner to substantially oppose to each other, and the other end thereof connected to two ropes for hanging the other end of the suspender, in a manner to substantially oppose to each other, a second lever which is mounted so as to be rotatable in a rotating direction of said first lever, a driver which rotates said second lever, and a damping device which connects at least one end of said first lever with at least one end of said second lever, and which operates in case of allowing said first lever to rotate relative to said second lever, to damp a force for rotating said first lever, and in the other case, to inhibit said first lever from rotating relative to said second lever.

2. An orientation control apparatus for a suspender as defined in claim 1, wherein said damping device comprises a first piston-cylinder assembly, a throttle valve through which a liquid flows owing to a movement of a piston rod of said piston-cylinder assembly, and a valve which determines propriety of the flow of the liquid, and wherein said first piston-cylinder assembly is interposed between at least one end of said first lever and at least one end of said second lever with said piston rod extended in the rotating direction of said first lever.

3. An orientation control apparatus for a suspender as defined in claim 2, wherein a second piston-cylinder assembly is interposed between the other end of said first lever and the other end of said second lever.

4. An orientation control apparatus for a suspender as defined in claim 1, wherein said driver is disposed so as to freely protrude and retract a rod of screw feed mechanism type, and said driver rotates said second lever through the protrusion and retraction of said rod.

5. An orientation control apparatus for a suspender, comprising:

a first lever which is mounted so as to rotate about its center between both its ends, and which has one end thereof connected to two ropes for hanging one end of the suspender, in a manner to substantially oppose to each other, and the other end thereof connected to two ropes for hanging the other end of the suspender, in a manner to substantially oppose to each other, a second lever which is rotated about a center of rotation provided in parallel with a center of rotation of said first lever, and which is disposed substantially in parallel with said first lever and at substantially the same position as that of said first lever in an axial direction of the center of rotation, a driver which rotates said second lever, and a damping device which connects at least one end of said first lever with at least one end of said second lever, and which operates in case of allowing said first lever to rotate relative to said second lever, to damp a force for rotating said first lever, and in the other case, to inhibit said first lever from rotating relative to said second lever.

6. An orientation control apparatus for a suspender as defined in claim 5, wherein said damping device comprises a first piston-cylinder assembly, a throttle valve through which a liquid flows owing to a movement of a piston rod of said first piston-cylinder assembly, and a valve which determines propriety of the flow of the liquid, and wherein said first piston-cylinder assembly is interposed between at least one end of said first lever and at least one end of said second lever with said piston rod extended in the rotating direction of said first lever.

7. An orientation control apparatus for a suspender as defined in claim 6, wherein a second piston-cylinder assembly is interposed between the other end of said first lever and the other end of said second lever.

8. An orientation control apparatus for a suspender as defined in claim 6, wherein:

said second lever comprises two plates which are arranged substantially in parallel with each other, and a member which connects said two plates except both ends of said two plates in a longitudinal direction thereof, and said first piston-cylinder assembly has a cylinder thereof arranged and mounted between said two plates of said second lever and has said piston rod attached to said first lever.

9. An orientation control apparatus for a suspender as defined in claim 8, wherein a connection point between said ropes and said first lever lies nearer to the center of rotation than a connection point between said first lever and said piston rod of said first piston-cylinder assembly, and the rope extending from said connection point toward said second lever is passed through a space which is defined by said two plates and said member of said second lever and which lies nearer to said center of rotation than a connection position between said piston-cylinder assembly and said second lever.

10. An orientation control apparatus for a suspender as defined in claim 5, wherein said driver is disposed so as to freely protrude and retract a rod of screw feed mechanism type, and said driver rotates said second lever through the protrusion and retraction of said rod.

11. An orientation control apparatus for a suspender comprising:

a truck which is rectilinearly moved on rails by a first driver, a first lever which is mounted on said truck with a center of rotation located between both ends thereof, whose longitudinal direction is set to be horizontal and orthogonal to a moving direction of said truck, and which is arranged between said rails and a base for supporting them, four ropes which hang the suspender and which are arranged substantially in parallel with said rails, two of said four ropes being attached to each end of said first lever, a rotary shaft which is rotatably mounted on said truck at a position spaced in the moving direction of said truck from the center of rotation of said first lever, and in parallel with an axial direction of said center of rotation, a second lever which is attached to a lower end of said rotary shaft at substantially the same level as a mounting level of said first lever, and which is arranged substantially in parallel with said first lever, a third lever which is mounted on an upper end of said rotary shaft, a second driver which is interposed between said truck and an end of said third lever, and which rotates said third lever through stretch and contraction of a rod, and a damping device which connects at least one end of said first lever with at least one end of said second lever, and which operates in case of allowing said first lever to rotate relative to said second lever, to damp a force for rotating said first lever, and in the other case, to inhibit said first lever from rotating relative to said second lever.

12. An orientation control apparatus for a suspender as defined in claim 11, wherein said rails are laid nearer to said center of rotation of said first lever than a connection point between said first lever and said ropes and a connection point between said first lever and said damping device.

* * * * *